United States Patent [19]

Roach

[11] Patent Number: 4,716,684

[45] Date of Patent: Jan. 5, 1988

[54] CLEANING AND DEBURRING OF MACHINED OR CAST PARTS

[76] Inventor: Larry A. Roach, 920 N. Jefferson, Mason City, Iowa 50401

[21] Appl. No.: 891,266

[22] Filed: Jul. 28, 1986

[51] Int. Cl.[4] ..... B24B 31/06

[52] U.S. Cl. ..... 51/7; 51/17; 51/317

[58] Field of Search ..... 51/6, 7, 16, 17, 317, 51/292, 163.1, 410, 417, 422, 426; 29/90.5

[56] References Cited

U.S. PATENT DOCUMENTS

| | | | |
|---|---|---|---|
| 3,581,440 | 6/1971 | McKinney et l. | 51/17 X |
| 3,584,419 | 6/1971 | Hulet et al. | 51/317 X |
| 4,387,537 | 6/1983 | Roach et al. | 51/7 X |

FOREIGN PATENT DOCUMENTS

| | | | |
|---|---|---|---|
| 256647 | 2/1913 | Fed. Rep. of Germany | 51/410 |
| 83361 | 5/1982 | Japan | 51/163.1 |
| 2019272 | 10/1979 | United Kingdom | 51/16 |
| 799940 | 1/1981 | U.S.S.R. | 51/7 |
| 804390 | 2/1981 | U.S.S.R. | 51/163.1 |

*Primary Examiner*—Robert P. Olszewski

*Attorney, Agent, or Firm*—Jacobson and Johnson

[57] ABSTRACT

A machined or cast part is rigidly attached to the interior of a container having an open top, closed side walls and a bottom with a restricted opening near or at the bottom of the container and abrasive cleaning and deburring material is inserted into the container through the top and the container is vibrated. A relatively small amount of the cleaning media is allowed to leave the container through the bottom opening and is replaced by adding abrasive material through the top and the vibrations cause the material to churn in the container upward around the part and into and through recesses and openings in the part.

10 Claims, 4 Drawing Figures

CLEANING AND DEBURRING OF MACHINED OR CAST PARTS

FIELD OF THE INVENTION

This invention relates to apparatus and method for cleaning, improving the original surface finish and deburring work pieces or parts such as castings or machined parts to remove rough edges, surface finishes and/or fins which are usually found on the part after it has been machined or removed from a mold. More specifically, the invention relates to cleaning and deburring by holding the part in a container, feeding abrasive cleaning and deburring material into the top of the container, vibrating the container and allowing a limited amount of the cleaning material to egress through the bottom of the container while feeding replacement cleaning material into the top of the container.

DESCRIPTION OF THE PRIOR ART

U.S. Pat. No. 4,387,537 dated June 14, 1983 by Maurice P. Roach, et al. describes the manner of cleaning and deburring work pieces using freefalling abrasive cleaning material. The work pieces are vibrated while the abrasive material is dropped on and into the work piece and allowed to cascade and freefall over, around and through the work piece.

As described in the aforementioned patent, a number of techniques have been used for cleaning and deburring including blast cleaning with abrasive material, using tumbling barrels which are filled with the cleaning material, vibratory tubs, and the like. The aforementioned patented technique comprises vibrating the work piece in an unconfined area and cascading or allowing the abrasive material to free fall over, around and through the piece. The patented technique is intended to overcome some of the problems with the earlier cleaning and deburring techniques but appears to have some flaws and drawbacks. For one, it is generally necessary to feed the abrasive material rapidly and in substantial volumes thereby requiring a fairly elegant system for gathering the reusable abrasive material and transporting it back to the feed input. Another deficiency is that some areas of the piece may not be effectively cleaned by the abrasive material, particularly recesses or openings which are relatively inaccessible, without using sophisticated mechanisms or means for turning the piece so that all sides are contacted by the freefalling abrasive material to be suitably cleaned or deburred. Also, the pattern of feed of the abrasive material must be such to be broad enough to cover the entire piece which can result in a significant amount of the abrasive material passing by or around the piece without contributing to the cleaning. As a result of the latter, it also appears that it takes a relatively long time to effectively clean and deburr a work piece using the patented technique.

SUMMARY OF THE INVENTION

The instant invention utilizes conventional types of abrasive material which are selected according to the nature of the work piece which is to be cleaned. Examples of the cleaning media are similar to those identified in the aforementioned patent such as crushed stone, carbide abrasive materials, metal shot, alumina oxide, silica, granite chips and the like. The work piece is mounted in a container having an open top, closed sidewalls and a bottom with a restricted opening at or near the bottom of the container. The abrasive material is fed into the top of the container and the container is vibrated. A relatively small amount of the abrasive material is allowed to fall out of the container through the bottom opening but the bulk of the material, due to the vibration action, is caused to churn or move in the container in a vortex fashion around and about the work piece to work its way into some of the normally inaccessible recesses or cavities and to continually polish, clean and deburr the work piece. The cleaning material which egresses through the bottom opening is replaced by feeding additional cleaning material through the top opening. Conventionally, the material which leaves the container through the bottom is fed back to the input side by some suitable conveyor which does not constitute part of the instant invention. However, it can be seen that the gathering of the material which leaves the container and feeding it back to the input can be done in a relatively simple fashion. Pieces cleaned and deburred in accordance with the teachings of this invention have been found to be more thoroughly cleaned and deburred at a more rapid rate than what has been experienced with prior art techniques. The vibration action in the instant invention is linear, for example, horizontally or transverse with respect to the direction of feed of the cleaning material, so that relatively simple commercially available vibrating machines can be utilized in addition to using simple commercially available conveyors for transporting the material which leaves the bottom of the container back to the feed station.

DESCRIPTION OF THE PREFERRED EMBODIMENT

Figure 2:
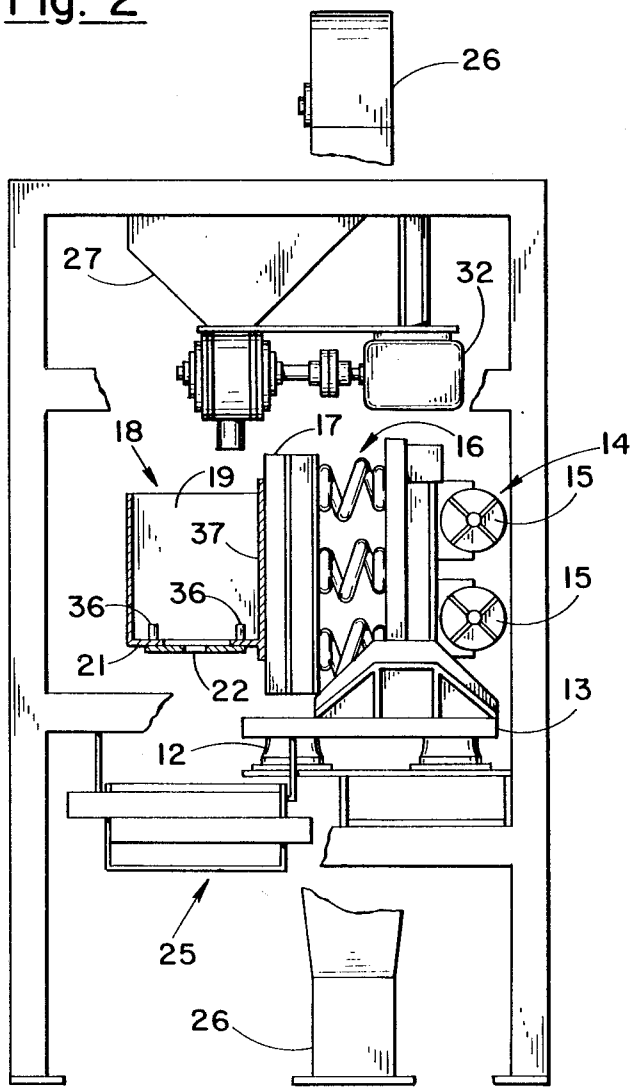
FIG. 2 is a vertical side view of the apparatus illustrated in FIG. 1.
Figure 1:
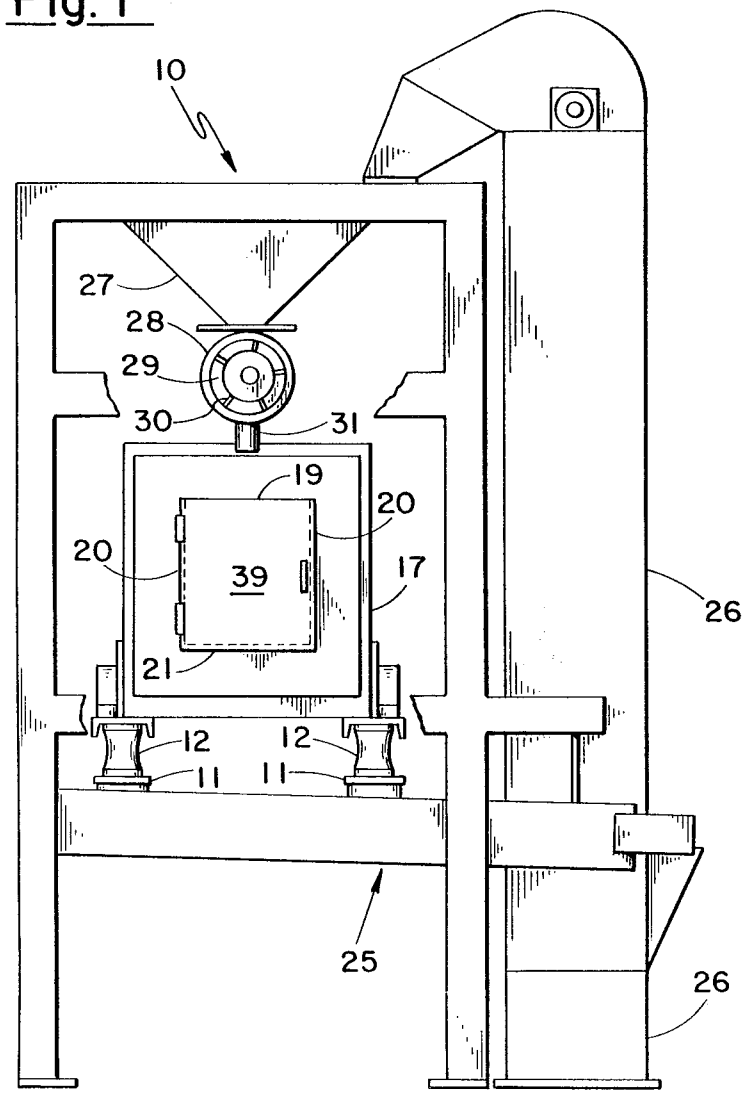
FIG. 1 is a vertical plan view showing the elements of an apparatus suitable for performing the functions of the invention.

The apparatus shown in FIGS. 1 and 2 is a machine which utilizes, for the most part, conventional and commercially available elements suitable for carrying out the functions of the invention. A main support frame 10 has crossbeams 11 on which are mounted upright vibrator isolator pads 12, usually made of rubber, which support a vibrator support plate 13. The vibrator, identified generally by reference numeral 14, conventionally has a pair of vibrator motors 15 which, through eccentric weights on the motor shaft, not shown, drive springs 16 via exciter plate 21 to move fixture plate 17 rhythmically at a certain frequency and length of stroke. Means, not shown, which are commercially available, may be provided to vary the frequency and stroke of the vibrator. The fixture plate 17 is moved back and forth linearally and in the illustration is moved in a lateral horizontal line. Attached to the other side of fixture plate 17 is a box-like container generally designated by reference numeral 18. The container has a top opening 19, enclosing sidewalls 20 and a bottom wall 21. A small opening 22 is provided in the bottom wall 21. The size of opening 22 preferably is adjustable.

Opening 22 can be placed in one (or more) of the container sidewalls 20 but should be located near the bottom of the container. Located under container 18 and positioned to receive the discharge of abrasive material from the container through opening 22 is a conventional vibratory conveyor designated by reference numeral 25. Material is carried by conveyor 25 to a conventional bucket elevator generally designated by reference numeral 26 which carries material which is deposited in the bucket elevator by conveyor 25 upwards and discharges it through a funnel-shaped hopper 27 into a conventional rotary valve feeder 28 or any other suitable feeder mechanism. Conventionally the latter has a series of compartments 29 formed by radially extending plates or vanes 30 and is rotated at a constant but adjustable speed by motor 32 to deposit the material received in each of the compartments 29 into the container 18 through the top opening 19 via a chute 31.

Figure 3:
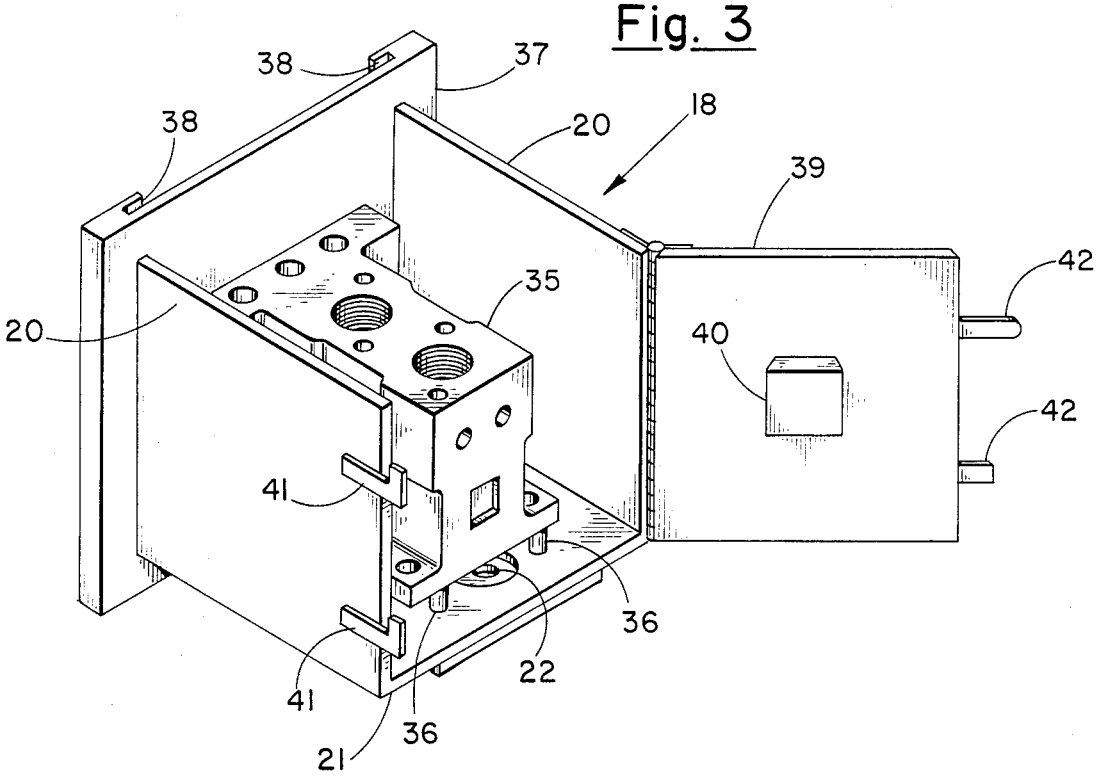
FIG. 3 is a perspective view illustrating a machined part held in a container for cleaning in accordance with the teachings of this invention.

The part to be cleaned, such as a machined work piece or a cast part removed from a mold, is inserted in container 18 and held tightly in the container in some convenient fashion so that it will not move in the container when vibrated. Typically, as illustrated in FIG. 3, a machined all-metal block 35 is inserted in container 18 resting on spacers 36 which extend upward from the bottom wall 21. The back enclosing wall 37 has an outer groove 38 for mating with a corresponding tongue (not shown) on fixture 17 to removably attach the container 18 to the fixture plate 17. On the inside of door 39 which is hingedly attached to one of the sidewalls 20 is a pad 40. When the door is closed, the pad 40 pushes firmly against the piece 35 so that it is held firmly in place between the pad and the back wall 37 while resting on the spacers 36. The door is then locked or latched in place through the combination of hooks 41 and arms 42. Alterntively, part 35 can be bolted in place on spacers 36 with a suitable bolt and nut arrangement, not shown, or the part can be held in place in container 18 in any suitable fashion. The opening 22 at the bottom of container 18 is illustrated in FIG. 3 as being located towards the door end of the container but it could be located at any desired spot in bottom wall 21. Also, opening 22 can be located at or near the bottom of side walls 20 or can be a combination of openings in the bottom wall 21 and the side walls 20.

In use, preferably the part(s) is mounted firmly and immovably in the interior of the container 18 and the container is filled with commercially available suitable abrasive material such as alumina oxide, silicon carbide, hardened metal shot or other shapes, ceramics, etc. The type of abrasive media that is used is a matter of choice and will usually depend upon the nature of the part that is to be cleaned and deburred, including the size of the part, the material, and the nature and size of any recesses or openings in the part which have to be cleaned out. Also, the size of the egress opening 22 at the bottom of the container will depend on a number of factors including the type of abrasive media that is used, the amount and the rate of cleaning, the amplitude and frequency of the vibratory action and the configuration of the part. After container 18 is filled with the media, the vibrator 14 is turned on. Some of the media leaves through opening 22 and is deposited in conveyor 25 and returned to container 18 through the top opening 19 via the bucket elevator 26, hopper 27, rotary valve 28 and chute 31. It may be necessary to provide additional abrasive material and to adjust the feed rate of rotary valve 28 since it is generally found that the best practice is to keep the container substantially filled with the abrasive media. It also may be necessary to adjust the size of the opening 22. If for example preliminary tests show that the time needed to clean the part is excessive or if the part is not being thoroughly cleaned, the opening may have to be enlarged or made smaller. It has been found that at a correct or optimum setting of the size of the opening 22, the horizontal or transverse vibratory action along with the vertical feed of the abrasive material causes most of the abrasive material to churn within the container or move in a vortex fashion up and around and through the part(s) to clean off all of the fins or rough edges on the outside as well as any cavities, recesses or interior passageways in the part. It has also been found that the frequency and the stroke of the vibrator may affect the cleaning rate and the feed rate. Typically, it has been found that a vibration frequency in the order of about 1800 vibrations per minute or greater with a $\frac{1}{4}$ inch stroke produces satisfactory results. The container constrains the cleaning media so that it churns repeatedly over, around and through the part while the egress opening 22 permits some of the media to leave the container to minimize or eliminate any packing of the abrasive material and to provide for the material to work its way around the part(s) in a vortex or churning fashion in an ever-changing pattern of movement. It has also been found that the periodic feeding of replacement media through rotary valve 28 helps in the process as compared to feeding the media into container 18 at a constant flow rate.

Figure 4:
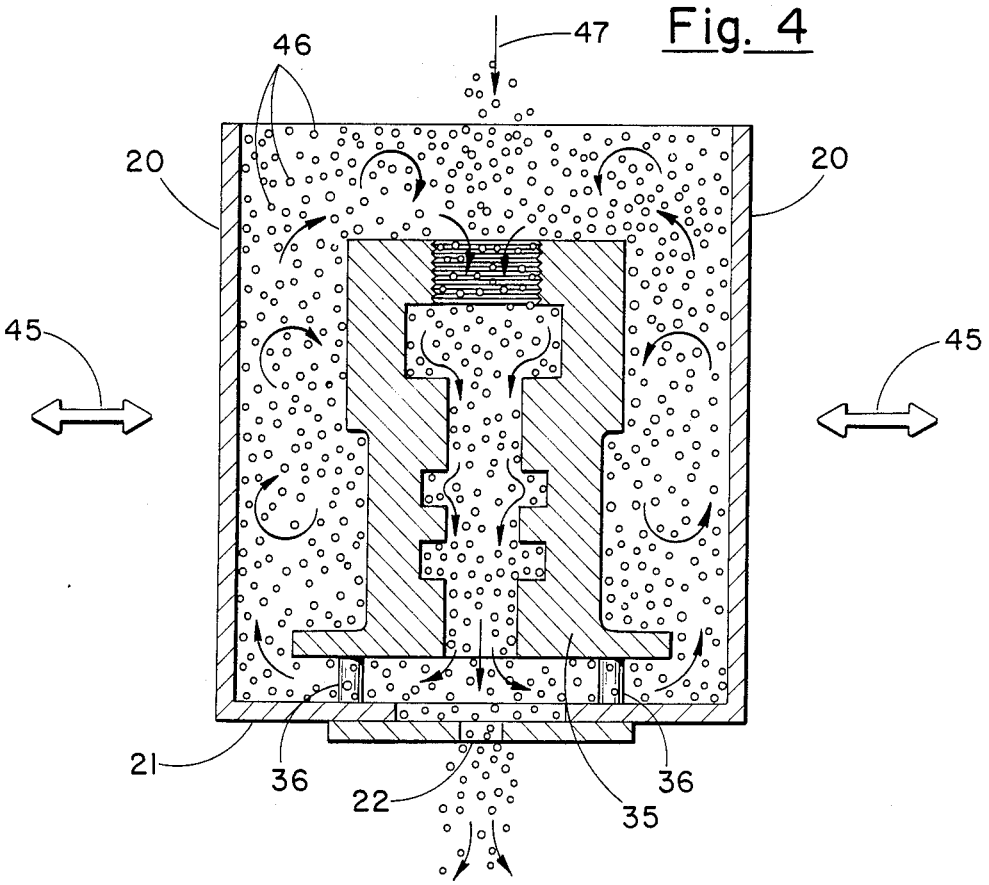
FIG. 4 is a diagramatic sectioned view illustrating the action of the abrasive cleaning media.

FIG. 4 diagramatically illustrates the churning or vortex action of the cleaning media within the container. As the container is vibrated transversely, depicted by arrow 45, some of the grains or beads 46 of the abrasive material move downward through the central opening of the part and in and out of the crevices or recesses in the central opening; some of the abrasive material egresses from container 18 through the bottom opening 22; and some of the material moves in the container along the bottom and back up along the outer sides of the part in a random and circuitous fashion to impinge upon all areas of the part (except where the part is being held) in a churning and/or vortex fashion. Additional abrasive material to replace the material that leaves through opening 22 is fed into the container through the open top as depicted by arrow 47.

I claim:

1. A method for abrasively cleaning and deburring cast or machined pieces or the like, comprising the steps of:

(a) attaching the pieces to be cleaned securely to the inside of a container having an open top, closed side walls and a bottom wall with a constricted opening at or near the bottom of the container for allowing a restricted amount of cleaning and deburring material to exit the container;

(b) then inserting abrasive cleaning and deburring material into the container through the open top and vibrating the container; and (c) then feeding abrasive cleaning and deburring material into the container through the open top while the container is vibrating to replace the cleaning and deburring material which leaves the container through the bottom opening.

2. The method as described in claim 1 in which step (b) comprises the steps of:

first substantially filling the container with abrasive cleaning and deburring material; and then vibrating the container.

3. The method as described in claim 1 wherein in step (c) the abrasive material is fed periodically into the container to replace the material which leaves through the bottom opening.

4. The method as described in claim 1 wherein in step (b) the container is vibrated to move a substantial amount of the abrasive material in and around the pieces in a vortex fashion.

5. The method of claim 1 wherein the container is vibrated linearly horizontally.

6. A method for abrasively cleaning and deburring cast or machined pieces and the like, comprising the steps of:

(a) attaching pieces to be cleaned securely to the interior of a container having an open top, closed side walls and a bottom wall;

(b) then inserting abrasive cleaning material into the container through the open top and vibrating the container;

(c) providing an opening in the container at or near its bottom to allow only a restricted amount of abrasive material to leave the container while it is being vibrated; and (d) then feeding abrasive material into the container through the open top while the container is being vibrated to replace the material which leaves through the bottom opening.

7. The method as described in claim 6 wherein the container is vibrated linearly horizontally.

8. Apparatus for abrasively cleaning and deburring cast or machined parts, comprising:

(a) a container having an open top, closed side walls, a bottom wall, and a restricted bottom opening for allowing a restricted amount of cleaning and deburring material to exit the container;

(b) means for securely holding parts to be cleaned within the interior of said container;

(c) abrasive cleaning and deburring material within said container substantially filling said container around the parts;

(d) means for vibrating the container; and (e) means for feeding abrasive cleaning and deburring material into said container through the open top to replace the material which leaves the container through the bottom opening.

9. The apparatus as described in claim 8 wherein said feeding means comprises:

means for periodically feeding abrasive material into the container.

10. The apparatus as described in claim 8 wherein said means for vibrating the container vibrates the container linearly horizontally.

* * * * *